US005833386A

United States Patent [19]

Rosan et al.

[11] Patent Number: 5,833,386

[45] Date of Patent: Nov. 10, 1998

[54] MODULAR ROLL-OUT PORTABLE FLOOR AND WALKWAY

[75] Inventors: Robert J. Rosan; Arnon J. Rosan, both of New York, N.Y.

[73] Assignee: Teletek Industries, Inc., New York, N.Y.

[21] Appl. No.: 861,977

[22] Filed: May 22, 1997

Related U.S. Application Data

[63] Continuation of Ser. No. 547,800, Oct. 25, 1995, abandoned.

[51] Int. Cl.[6] ..... E01C 5/20

[52] U.S. Cl. ..... 404/36; 404/41; 52/177; 52/588.1; 428/54

[58] Field of Search ..... 15/215; 52/177, 52/180, 579, 581, 588.1, 580; 404/18, 34, 35, 36, 41; 428/44, 45, 54

[56] References Cited

U.S. PATENT DOCUMENTS

| | | | |
|---|---|---|---|
| 4,167,599 | 9/1979 | Nissinen . | |
| 4,226,064 | 10/1980 | Kraayenhof . | |
| 4,468,910 | 9/1984 | Morrison . | |
| 4,584,221 | 4/1986 | Kung . | |
| 4,749,302 | 6/1988 | DeClute . | |
| 4,766,020 | 8/1988 | Elungson, Jr. | 428/54 |
| 4,826,351 | 5/1989 | Haberhauer et al. . | |
| 4,877,672 | 10/1989 | Shreiner | 428/156 |
| 4,917,532 | 4/1990 | Haberhauer et al. . | |
| 4,964,751 | 10/1990 | Rope et al. . | |
| 5,157,804 | 10/1992 | Williams | 15/161 |
| 5,190,799 | 3/1993 | Ellingson, Jr. | 428/53 |
| 5,215,802 | 6/1993 | Sijpesteijn . | |
| 5,364,204 | 11/1994 | MacLeod . | |
| 5,527,128 | 6/1996 | Rope et al. . | |

*Primary Examiner*—James Lisehora
*Attorney, Agent, or Firm*—Darby & Darby

[57] ABSTRACT

A modular platform suitable for use as a portable roll-out walkway or floor comprising a plurality of interconnected treads of a lightweight molded or formed thermoplastic material, each of the treads comprising a top surface for supporting loads thereon, a ground-engaging bottom surface, and four side portions comprising two adjacent male side portions and two adjacent female side portions disposed between the bottom and top surfaces, the side portions comprising interconnecting member integral with the tread for selectively disengageable interconnection with adjacent treads to configure the platform in variable sizes as desired. The top surface comprises drainage apparatus to allow passage therethrough of air and water. The bottom surface comprises a plurality of ribs spaced so as to form cavities in cooperative relation with the drainage apparatus so as to disperse weight loads, allow passage thereto of water drained through the drainage apparatus, and maintain a moisture canopy underneath the treads. Each of the male side portions comprises an insertion member disposed substantially along the length thereof, comprising an integral living hinge to allow hinged pivoting and an interlocking tab. Each of the female side portions comprises a channel member disposed substantially along the length thereof and adapted to mate with an opposing insertion member located on an adjacent tread, the channel member comprising a mating slot disposed thereon so as to mate in snap-fit relation with an interlocking tab of an adjacent tread when the insertion member of the interlocking tread is inserted in the channel member.

2 Claims, 5 Drawing Sheets

Fig. 7
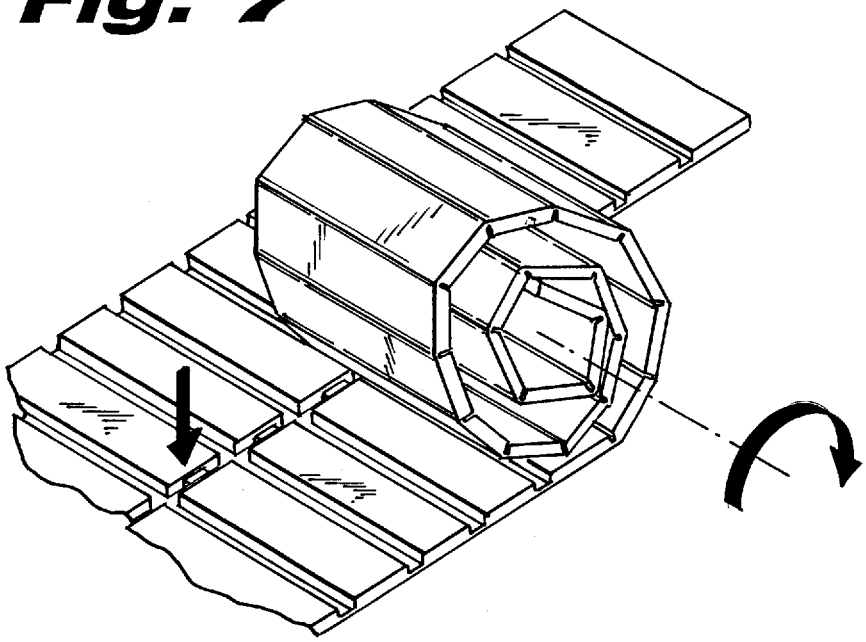
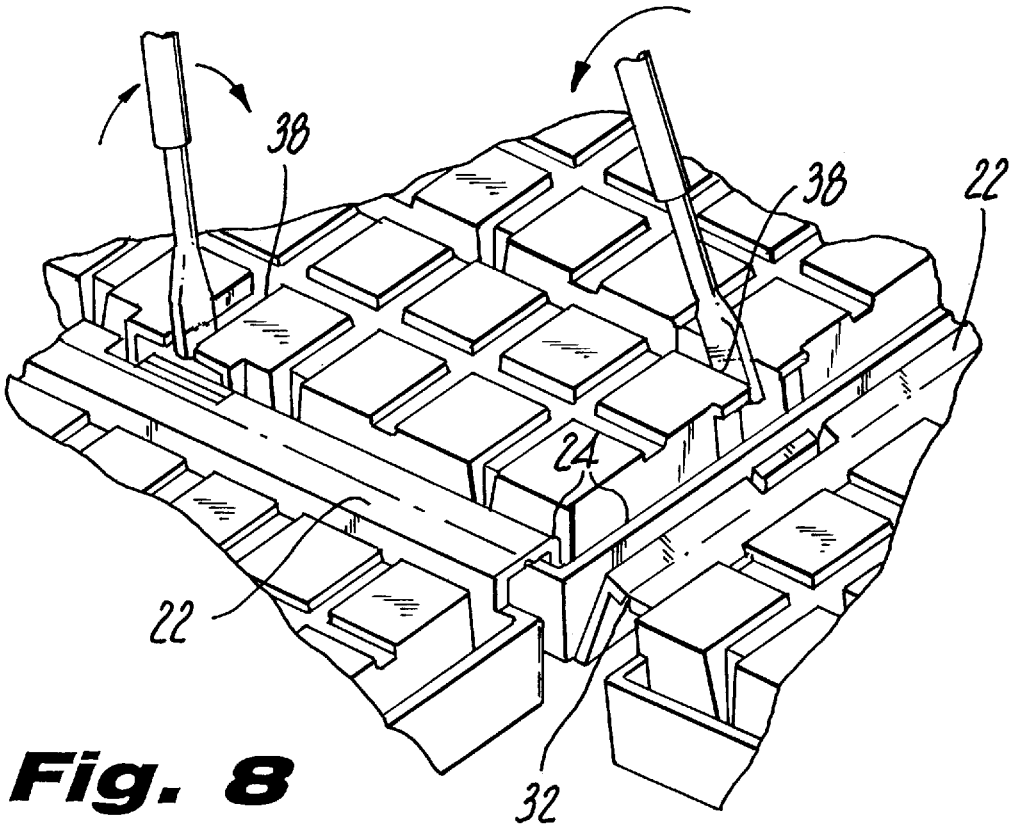
Fig. 8

MODULAR ROLL-OUT PORTABLE FLOOR AND WALKWAY

This is a continuation of application Ser. No. 08/547,800, filed Oct. 25, 1995, now abandoned.

BACKGROUND OF THE INVENTION

The present invention relates to roll-out portable walkways and flooring, and in particular to a lightweight plastic tread used to configure a modular roll-out portable walkway or floor in shapes and sizes as desired by a user, and intended to protect sub-surfaces, such as grass lawns or synthetic grass surfaces, upon which it is placed.

Portable roll-out walkways and floors find many uses in both indoor and outdoor applications. In particular, portable floors are used to cover grass and/or dirt areas under and around large outdoor tents, to provide access for wheelchairs on uneven or unstable surfaces such as gravel and sandy beaches, to provide lawn protection and vehicular access in selected sites, and the like. Usually, such portable floors are installed at a site for a short duration of time and then removed to allow the normal use of the site to resume.

Due to the large areas over which such portable walkways and floors are usually placed, it is desired that such walkways be lightweight to allow easy and convenient installation, and transport by the installer both to and from the site of installation. It is also desired that such a portable floor or walkway be configurable to the dimensions required at the particular site; i.e. the length and width and shape of the areas to be covered dictates the installation.

It is also desired that such a floor be constituted so as to disperse surface weight loads so as to protect the underlying surface.

Thus, a modular approach has been taken in the past to providing such portable floors. For example, wooden platforms have been installed to provide temporary floors under outdoor tents at events such as weddings. The disadvantages of such an installation are evident; to wit, the weight of the wooden sections preclude easy and quick installation and removal, the mass prevents flow of air and water from reaching the ground surface and also prevents built up heat from escaping, thus damaging grassy areas, etc. In addition, the wooden platforms must each be installed, connected together, taken apart, carried away individually and stacked for storage, requiring lengthy installation and removal time.

U.S. Pat. No. 4,964,751 provided a modular plastic walkway comprised of treads interconnected by means of thin connecting strips connected to each tread by means of a snap-fit ball member. While this tread solved some problems of the prior art, such as being lightweight and capable of being rolled along its sides for easy storage, other problems remained and have been heretofore unsolved. Notably, the gaps between interconnected treads could cause ladies high heeled shoes to become lodged therebetween. Moreover, due to the use of separate interconnecting strips, installation and removal of the treads were still fairly time-consuming. Problems could arise should the installer misplace some connecting strips, and thus be unable to connect the treads.

It is therefore an object of the present invention to provide an improved modular roll-out portable walkway and floor which overcomes these and other problems of the prior art.

In particular, it is an object of the present invention to provide such a modular roll-out portable walkway and floor with lightweight, easy to install and remove treads having built-in integral connection means so as to overcome the disadvantage of separate connecting strips as in the prior art.

It is a further object of the present invention to provide such a modular tread which quickly and easily connects to adjacent treads to allow quick and easy installation.

It is a still further object of the present invention to provide such a modular tread which is easily disconnected from adjacent treads to allow quick and easy removal of an entire installation or an individual tread as desired, and reconfiguration of the floor or path.

It is a further object of the present invention to provide such a modular tread which is lightweight and capable of draining water off the top surface to avoid accidental slippage by those walking or riding thereon, to provide irrigation to the grassy areas underneath after the floor treads are installed, to provide passage therethrough of light and air to further obviate the potential for damage to the grass underneath, to maintain a moisture canopy underneath the treads and to allow circulation therefrom of heat buildup to even further obviate the potential for damage to the grass underneath.

It is an even further object of the present invention to provide a modular tread which can be securely interconnected to adjacent treads without allowing adjacent treads to be displaced with respect to each other, thus forming a stable and even walkway or floor with maximum alignment of the treads, and no gaps between the treads.

It is a still further object of the present invention to provide such a modular tread which is hinged at the sides such that a series of interconnected treads may be rolled around itself as desired to facilitate easy removal, installation and storage.

It is a still further object of the present invention to provide a modular tread which can disperse the concentrated weight loads of people, equipment and vehicles so as to prevent the creation of deep grooves or marks in an underlying grass or lawn surface.

SUMMARY OF THE INVENTION

In accordance with these and other objectives, provided is a modular roll-out portable platform suitable for use as a walkway or floor comprising a plurality of interconnected treads of a lightweight molded or formed thermoplastic material, each of the treads comprising a top surface for supporting loads thereon, a ground-engaging bottom surface configured to distribute weight loads, and four side portions comprising two adjacent male side portions and two adjacent female side portions disposed between the bottom and top surfaces, the side portions comprising interconnecting means integral with the tread for selectively disengageable interconnection with adjacent treads to configure the platform in variable sizes as desired.

In addition, the top surface comprises drainage means comprising drainage channels recessed with respect to the top surface and comprising a plurality of drainage openings to allow passage therethrough of air and water, and a plurality of raised portions spaced apart so as to form recessed spaces therebetween, the recessed spaces coupled with the drainage channels so as to aid in draining water off the top surface. The bottom surface of the tread comprises a plurality of ribs extending in spaced relation therebetween so as to form cavities between an underside of the top surface and the ground when the treads are placed on the ground, the cavities being in cooperative relationship with the drainage means so as to allow passage thereto of water drained through said drainage means, and configured to maintain a moisture canopy within the cavity, and the ribs being spaced to disperse the weight loads placed upon the top surface.

As to the interconnection means of the present invention, each of the male side portions comprises an insertion member, the insertion member being in inverted substantially U-shaped cross-section and disposed substantially along the length thereof, the insertion member comprising an integral living hinge formed by a cross-section relatively thinner in its middle than on adjacent outer portions thereof to allow hinged pivoting therebetween; and interlocking tab means comprising a resilient tab protrusion disposed on an outer portion thereof. Each of the female side portions comprises a channel member, the channel member being in substantially U-shaped cross-section and disposed substantially along the length thereof and adapted to mate with an opposing insertion member located on an adjacent tread; the channel member comprising mating slot means disposed thereon so as to mate in snap-fit relation with an interlocking tab means of an adjacent tread when the insertion member of the interlocking tread is inserted in the channel member; and tab disengagement means comprising a fulcrum opening perpendicularly juxtaposed with said mating slot for allowing insertion therein of a lever for selective disengagement of said interlocking tab means from said mating slot.

Accordingly, any number of said treads may be interconnected along any side portion to form a modular path or platform in any desired dimension, and portions of the path or platform may be rolled as a result of the flexibility of the living hinges.

BRIEF DESCRIPTION OF THE DRAWING

FIG. 7 illustrates the installation of separately assembled rolls of interconnected treads to form a modular floor or walkway; and FIG. 8 illustrates the detachment of adjacent treads by means of a lever in conjunction with fulcrum openings in the tread of FIG. 1.

DETAILED DESCRIPTION OF THE PREFERRED EMBODIMENT

Figure 1:
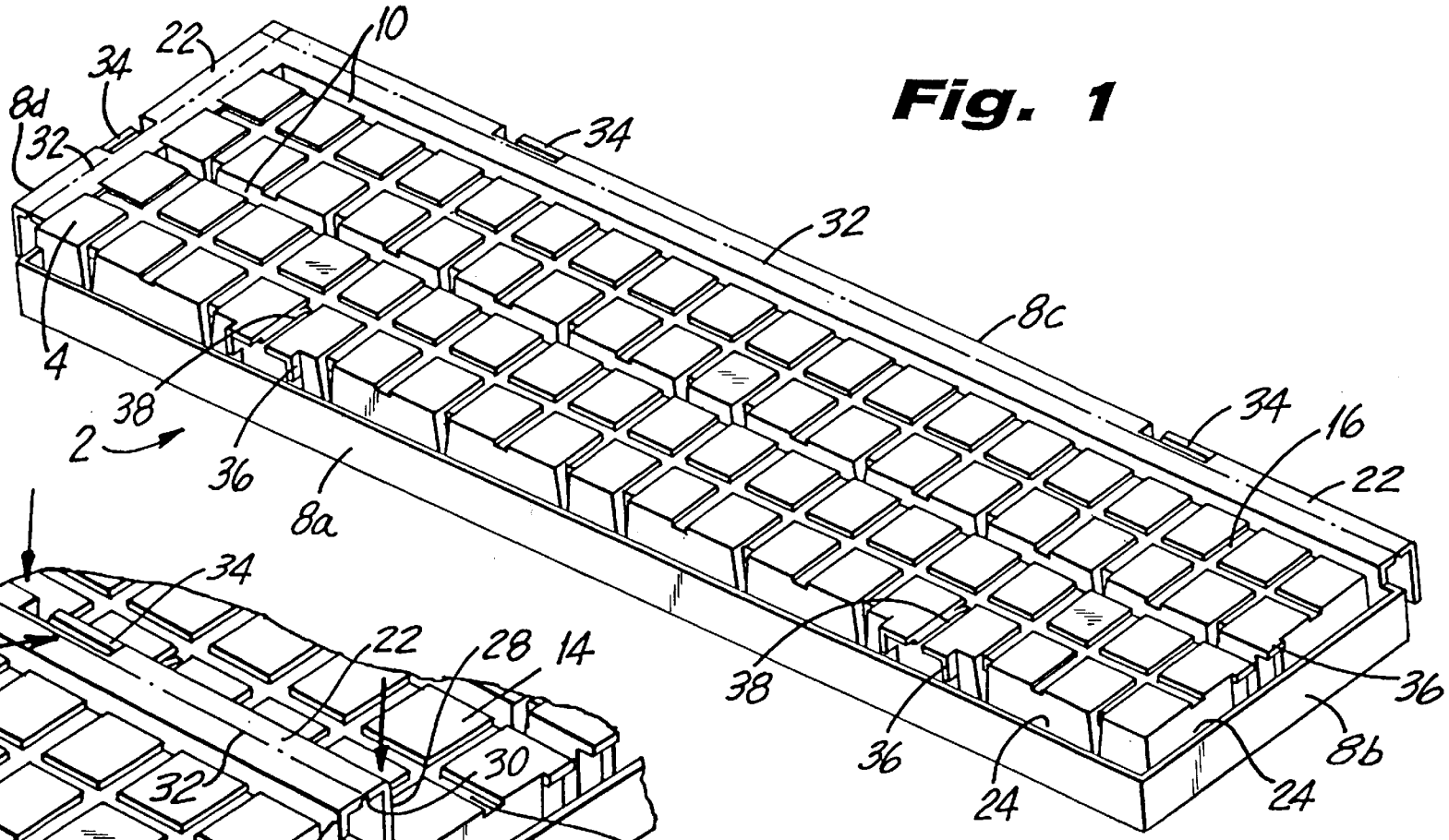
FIG. 1 is a perspective view of a modular walkway and floor tread of the preferred embodiment of the present invention.
Figure 2:
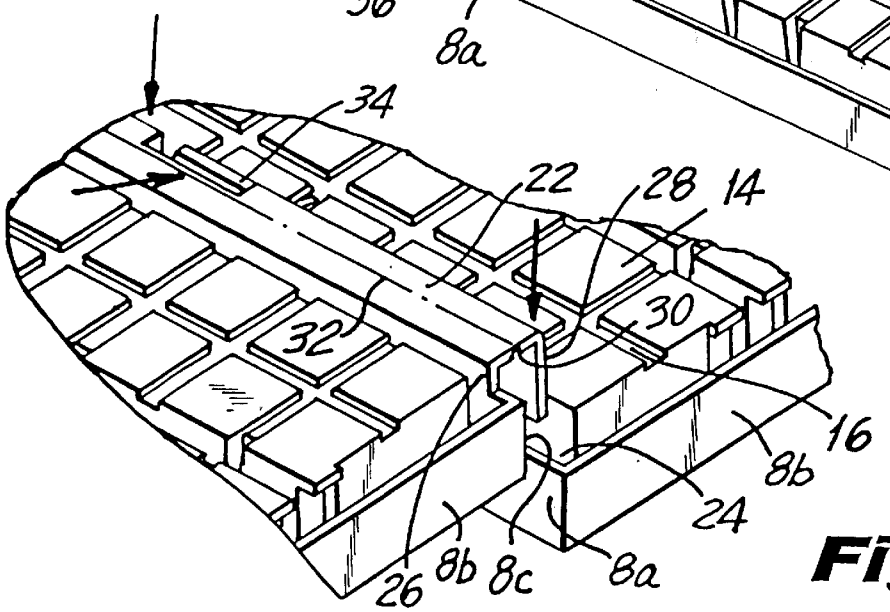
FIG. 2 is a perspective illustration of the interconnection of two adjacent treads in accordance with the present invention.
Figure 3:
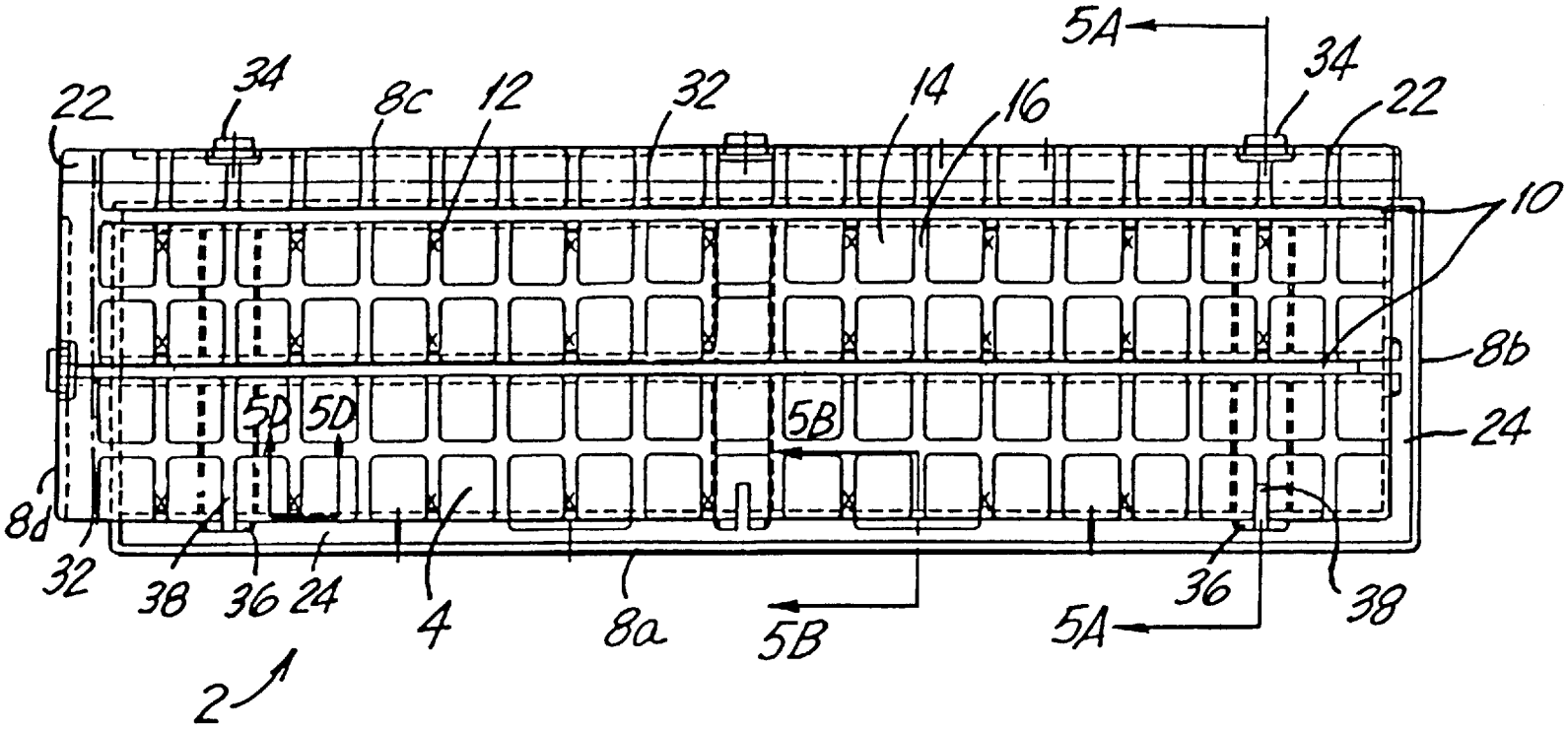
FIG. 3 is a top plan view of the tread of FIG. 1.
Figure 4C:
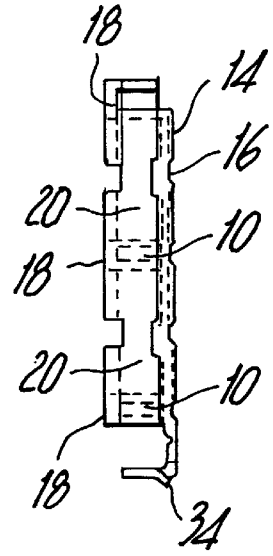
FIG. 4(C) is an end plan view of the tread of FIG. 1.
Figure 4A:
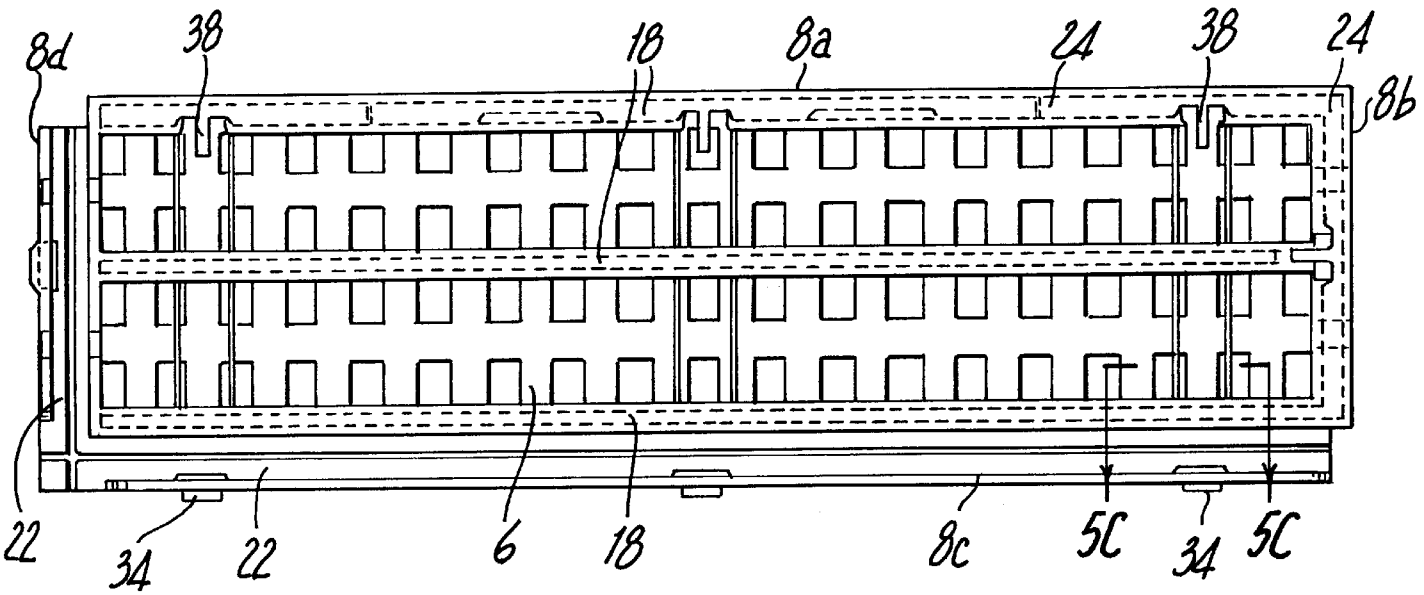
FIG. 4(A) is a bottom plan view of the tread of FIG. 1.
Figure 4B:
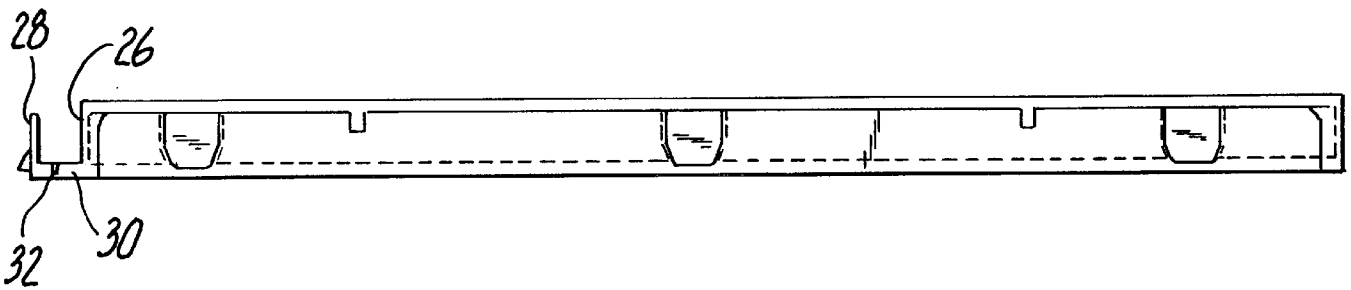
FIG. 4(B) is a side plan view of the tread of FIG. 1.

Referring generally to the Figures, the preferred embodiment of the present invention will now be described in detail. FIG. 1 illustrates in perspective view a modular tread 2 used to assemble, as desired, a floor or walkway in accordance with the present invention. The tread 2 is of unitary construction and is formed by injection molding or the like of a lightweight thermoplastic material such as polypropylene or the like.

The tread 2 is of generally elongate shape and has a top surface 4, a bottom surface 6, and four side portions which are referred to in common by reference numeral 8 but which are comprised of a female side 8*a*, a female end 8*b*, a male side 8*c*, and a male end 8*d*. The male side 8*c* and male end 8*d* are substantially identical to each other in function and design except for their difference in relative length and number of connecting means (to be explained in detail below). Likewise, the female side 8*a* and female end 8*b* are substantially identical to each other in function and design except for their difference in relative length and number of connecting means (to be explained in detail below).

Figure 5A:
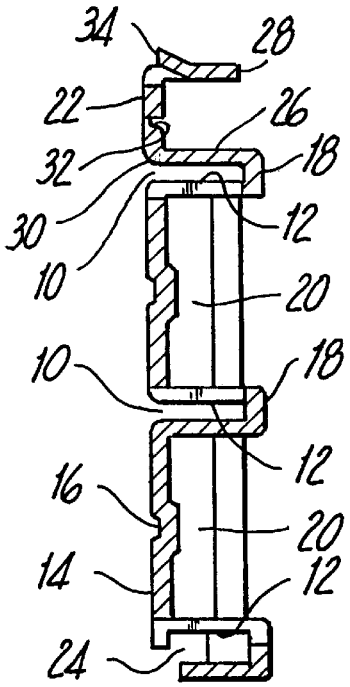
FIG. 5(A) is a cross-section view taken along line A—A of FIG. 3.
Figure 5B:
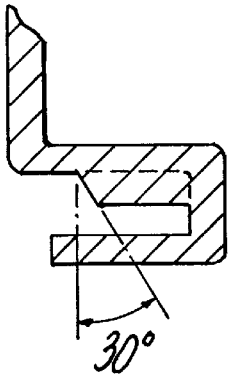
FIG. 5(B) is a cross-section view taken along line B—B of FIG. 3.
Figure 5C:
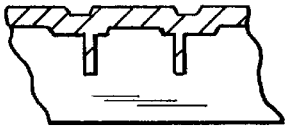
FIG. 5(C) is a cross-section view taken along line C—C of FIG. 4(A)
Figure 5D:
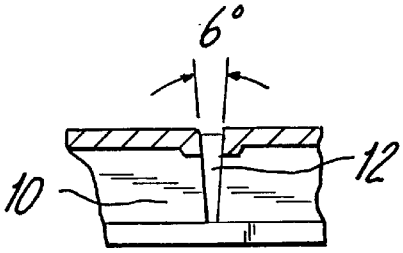
FIG. 5(D) is a cross-section view taken along line D—D of FIG. 3.
Figure 6:
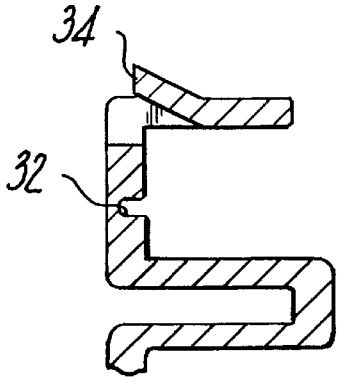
FIG. 6 is a close-up detailed view of the lock tab and hinge of the tread of FIG. 1.

The top surface has molded therein an array of raised portions 14 which serve to provide traction for persons walking on the tread as well as to define a matrix of recessed spaces 16 between adjacent raised portions. The recessed spaces 16 help to channel off water (such as from rain) into drainage channels 10, which run along the long dimension of the top surface 4 of the tread 2. Disposed at regular intervals along each drainage channel 10 are drainage openings 12 as shown in FIG. 5(A), which allow water in the channels 10 to escape through the tread 2 into cavities 20 formed below the top surface 4 by ribs 18. The ribs 18, as can be seen in the Figures, function to provide structural stability to the tread 2 as well as to provide a convenient means for the drainage channel 10 to direct water off of the top surface 4. In addition, the drainage openings 12 allow passage therethrough of light and air, thus providing circulation for the grass which may be covered by the tread 2. The combination of the water and light help preserve the grass underneath, thus maintaining the original site in the same condition as prior to the floor installation. Heat buildup which may occur is also allowed to be released via the drainage openings 12 into the atmosphere, thus further ameliorating the potential deleterious effects of the floor on a grassy surface. Moreover, the underlying cavities and drainage openings are intended to maintain in the air space created thereby, a moist environment to help preserve the grass underneath and prevent damage by reason of excessive dryness or heat buildup. That is, the underside of the top and side surfaces comprises a canopy which retains a certain amount of moisture, thus preventing the grass from drying out and reducing grass burn.

Both the male side 8*c* and the male end 8*d* comprise an insertion member 22, which runs along substantially the entire length of the male side and male end, respectively. Likewise, the female side 8*a* and the female end 8*b* each comprise a channel member 24, which run along substantially the entire length of the female side and the female end, respectively. As will be seen, adjacent treads are easily and conveniently interconnected by placement of an insertion member 22 of a male side 8*c* into the channel member 24 of a female side 8*a* of an adjacent tread in order to attach treads for their full length in side-to-side fashion, and likewise, if desired, adjacent treads are interconnected by placement of an insertion member 22 of a male end 8*d* into the channel member 24 of a female end 8*b* of an adjacent tread in order to attach treads for their full width in end-to-end fashion. The result of adjoining treads in side-to-side and/or end-to-end fashion allows the custom configuration of a floor or walkway in the shape and size desired by the particular site application, without leaving any gaps between the attached sides or ends.

The details of this interconnection in accordance with the present invention will, for sake of simplicity, be directed towards the side-to-side connection of adjacent treads, but is understood to be equally applicable to end-to-end interconnection of treads. The insertion member 22 is of inverted U-shape in cross section, having an inner wall 26 integral with the body of the tread 2, an outer wall 28, and a hinged connecting member 30 adjoining the inner wall to the outer wall. The outer wall 28 is adapted to fit within the channel member 24 of the adjacent tread so that the two treads are in close proximity to each other and form a substantially contiguous surface when so assembled.

The channel member 24 of the female side 8*a* is of U-shape in cross section and is adapted to mate with the outer wall 28 of the insertion member 22 of an adjoining tread 2 as above described and illustrated in the Figures. The channel member 24 is provided with a plurality of drainage openings 12 in like fashion of the drainage channels 10, and thus provides water, air, and light passage therethrough in the same fashion as the drainage channels 10. Although the drainage function is somewhat limited when the insertion member 22 of an adjoining tread 2 is placed therein, experience teaches that some passage occurs and helps in the overall drainage function of the tread 2. Moreover, in treads 2 which border the periphery of the floor or walkway, the drainage functions of the channel member 24 is uninhibited since there is no insertion member 22 placed therein at this location.

Provided along each insertion member 22 is a living hinge 32, which runs along the center of the hinged connecting member 30 as shown in the various Figures. The living hinge is formed by molding the thickness at that portion to be relatively thinner than the remaining connecting member, thus allowing the user to bend the outer portion (including the outer wall 28 and the outer half of the connecting member 30) in relation to the inner portion (including the inner wall 26 and the inner half of the connecting member 30). Due to the resiliency of the polypropylene or other thermoplastic material used to form the tread 2, the living hinge 32 will withstand numerous bending operations and will not break under normal operation of the treads. When a series of treads 2 are interconnected in side-to-side (or end-to-end) fashion, they can be rolled around each other due to the bendability of the living hinges 32, as can be seen in FIG. 7. This is especially advantageous when removing portions of an existing installation, which can be rolled up and stored without having to disassemble completely all of the treads from each other.

The integral interconnecting means will now be described in detail. Each insertion member 22 has formed therein tab protrusions 34, which are adapted to snap-fit into mating slots 36 located within channel members 24 of adjacent treads 2. Due to the resiliency of the thermoplastic material of the tread, the tab 34 will be slightly bent by the channel member 24 upon insertion of the insertion member 22 into the channel member 24, and will snap back to its quiescent position and into the slot 36 upon completion of the insertion process. The tab 34 fits snugly within the slot 36 and is not readily removable from the slot 36, thus ensuring a snug conforming fit of adjacent treads when assembling the floor or walkway.

Adjacent to each slot 36 is a fulcrum opening 38, which is situated perpendicularly to the slot 36 in a T-shape. By inserting a tool such as a screwdriver as shown in FIG. 8, and using the tool and end of the fulcrum opening in a lever-like fashion, the tool will cause the tab 34 to bend back past the clearance of the slot 36 and will force the tab 34 up and out of the slot 36 for easy removal when desired.

A floor constructed of an array or matrix of the treads described herein provides a stable and contiguous surface upon which tables, chairs, people, musical equipment, vehicles, etc., may be placed. Due to the close integral connecting members described herein, such a floor has no appreciable relative movement of the treads with respect to each other, which is a distinct advantage over the prior art. The snug-fitting connecting members keep the resulting structure in alignment at all times of use regardless of the traffic or load under which it is placed.

The use of a lightweight polypropylene in the preferred embodiment allows resilient yet bendable (at the living hinge and tab protrusion) properties to be imparted to the tread. It is understood, however that the present invention is not limited to the use of polypropylene and may be fabricated from any such material which imparts the properties desired as described herein.

Due to the modularity of the treads of the present invention, floors and walkways can be configured in any size or shape as desired. Moreover, although the preferred shape of the present invention is a rectangle, it is also understood that other shapes may be used within the spirit and scope of the present invention; e.g. squares, hexagons, etc.

We claim:

1. A modular platform suitable for use as a portable walkway or floor comprising a plurality of interconnected treads, each of said treads comprising:

a) a top surface for supporting loads thereon;

b) a ground-engaging bottom surface;

c) a plurality of side portions disposed adjacently between said bottom and top surfaces, comprising at least one male side portion and at least one opposing female side portion; and d) interconnecting means integral with said tread for selectively disengageable interconnection with adjacent treads to configure said platform in variable sizes as desired, wherein said interconnecting means comprises interlocking tab means disposed on said male side portion of said tread and mating slot means disposed on said female side portion of said tread, said mating slot means being arranged so as to mate with interlocking tab means of an adjacent tread in selectively disengageable interconnection therewith;

wherein said treads are formed from a lightweight thermoplastic material and wherein said interlocking tab means are comprised of a resilient tab protrusion, and wherein said tab protrusion is caused to snap fit into a mating slot means of an adjacent tread, and wherein said treads further comprise tab disengagement means for selectively disengaging said interlocking tab means from a mating slot means of an adjacent interconnected tread, and further, wherein said tab disengagement means comprises a fulcrum opening perpendicularly juxtaposed with said mating slot for allowing intersection therein of a lever for selective disengagement of said interlocking tab means from said mating slot;

wherein said male side portion comprises an insertion member, said insertion member being an inverted substantially U-shaped cross-section and disposed substantially along the length thereof, said insertion member comprising an outer portion, and said interlocking tab means are disposed on said outer portion; and wherein said female side portion comprises a channel member, said channel member being in substantially U-shaped cross-section and disposed substantially along the length thereof and adapted to mate with an insertion member located on an adjacent tread; and wherein said mating slot means are disposed on said channel member so as to mate with an interlocking tab means of an adjacent tread when the insertion member of said interlocking tread is inserted in said channel member; and wherein said insertion member comprises hinge means for allowing said outer portion to pivot in relation to said tread whereby a plurality of treads interconnected in series may be formed into a roll for easy storage thereof.

2. A modular platform suitable for use as a portable walkway or floor comprising a plurality of interconnected elongate treads of a lightweight molded or formed thermoplastic material and substantially rectangular in plan, each of said treads comprising:

(a) a top surface for supporting loads thereon, said top surface comprising drainage means comprising:

(i) a drainage channel recessed with respect to said top surface and comprising a plurality of drainage openings to allow passage therethrough of air and water; and (ii) a plurality of raised portions spaced apart so as to form recessed spaces therebetween, said recessed spaces coupled with said drainage channel so as to aid in draining water off said top surface;

(b) a ground-engaging bottom surface comprising a plurality of ribs extending in spaced relation therebetween, said ribs being spaced so as to form cavities between an underside of said top surface and the ground when said treads are placed on the ground, said cavities being in cooperative relation with said drainage means so as to allow passage thereto of water drained through said drainage means; and (c) four side portions comprising two adjacent male side portions and two adjacent female side portions disposed between said bottom and top surfaces;

wherein each of said male side portions comprises:

an insertion member, said insertion member being in inverted substantially U-shaped cross-section and disposed substantially along the length thereof, said insertion member comprising an integral living hinge formed by a cross-section relatively thinner in its middle than on adjacent outer portions thereof to allow hinged pivoting therebetween, and interlocking tab means comprising a resilient tab protrusion disposed on an outer portion thereof; and wherein each of said female side portions comprises:

a channel member, said channel member being in substantially U-shaped cross-section and disposed substantially along the length thereof and adapted to mate with an opposing insertion member located on an adjacent tread; said channel member comprising mating slot means disposed thereon so as to mate in snap-fit relation with an interlocking tab means of an adjacent tread when the insertion member of said interlocking tread is inserted in said channel member; and tab disengagement means comprising a fulcrum opening perpendicularly juxtaposed with said mating slot for allowing insertion therein of a lever for selective disengagement of said interlocking tab means from said mating slot;

whereby any number of said treads may be interconnected along any side portion to form a modular platform in any desired dimension, and whereby portions of said platform may be rolled as a result of the flexibility of the living hinges.

* * * * *